US005102360A

United States Patent [19]

Eycleshimer

[11] Patent Number: 5,102,360

[45] Date of Patent: Apr. 7, 1992

[54] SHIPBOARD CONTAINER FOR SURVIVAL EQUIPMENT

[76] Inventor: Robert G. Eycleshimer, Rte. 4, Box 33B, Hawthorne, Fla. 32640

[21] Appl. No.: 544,612

[22] Filed: Jun. 27, 1990

[51] Int. Cl.[5] ..... B63C 5/00

[52] U.S. Cl. ..... 441/80; 206/803; 206/822

[58] Field of Search ..... 441/32, 80, 84, 85; 114/190, 219; 206/803, 822

[56] References Cited

U.S. PATENT DOCUMENTS

| | | | |
|---|---|---|---|
| 2,088,251 | 7/1937 | Walters | 441/85 |
| 3,363,269 | 1/1968 | Kossuth | 5/81 |
| 3,754,291 | 8/1973 | Harris et al. | 114/190 |
| 3,962,740 | 6/1976 | White . | |
| 4,033,002 | 7/1977 | Higgs . | |
| 4,252,073 | 2/1981 | Hartung et al. | 114/219 |
| 4,498,879 | 2/1985 | Burr | 441/80 |
| 4,631,038 | 1/1986 | Ritter et al. | 441/80 |
| 4,664,053 | 5/1987 | Mesinger | 114/219 |
| 4,788,926 | 12/1988 | Ullman et al. | 114/219 |

*Primary Examiner*—Sherman Basinger

*Attorney, Agent, or Firm*—Kerkam, Stowell, Kondracki & Clarke

[57] ABSTRACT

A shipboard container for storing survival equipment at an above-deck location on seagoing vessel is provided, the container being of an elongated tube shape having an end cap at either end thereof, at least one of which is detachable or removable to allow access to the interior storage area of the container, the tube also having one or more flat panels to assist in stable storage against flat surfaces. The container is provided with a polypropylene rope tether secured to the detachable end cap, the tether being used to secure the container to the deck by wrapping the tether around the container and a handrail or other deck hardware, whereby the container may be readily and rapidly unleashed and taken overboard during an emergency situation. Reflective material and identifying indicia are also provided on an exterior surface of the container.

32 Claims, 3 Drawing Sheets

SHIPBOARD CONTAINER FOR SURVIVAL EQUIPMENT

BACKGROUND OF THE INVENTION

1. Field of the Invention

The present invention relates to containers for carrying survival equipment on seagoing vessels and particularly on sailing vessels.

2. Description of Related Art

Heretofore, survival equipment for use in "abandon ship" situations has been kept aboard sailboats, for example, in bag-type containers, and has been stored below the deck secured in a locker. One example of an "abandon ship bag" known in the art is made of a waterproof, rip-stop nylon filled with some type of flotation material, and employs a zipper closure. The survival equipment is stored inside the bag. This type of survival equipment container suffers from several drawbacks, for example, the material from which the bag is made is not suited to be left for extended periods in areas above the deck and exposed to the elements. Further, the use of a zipper all but eliminates the waterproof characteristics of the bag. The zipper will also corrode in a salt water atmosphere, preventing access to the contents of the bag.

Because the bag must be stored below the deck, it will likely be inaccessible in many boating emergencies which simply do not allow time for a crew member to go below and retrieve the bag. In addition, in situations where the crew must abandon ship, chaos, confusion and even panic can lead to a failure to realize the need to retrieve the bag containing the survival equipment.

U.S. Pat. No. 3,962,740, issued to White, recognizes the problems associated with storing survival equipment in a locker below the deck of the boat. A survival kit is described in that patent as being containerized and attached to the underside of the hull of the boat. While this device avoids the problems associated with storing survival equipment below the deck, it has several drawbacks of its own. The container will be substantially constantly exposed to and submerged in water, which can cause even the most "watertight" containers to experience leaks. The presence of the container or containers on the hull will likely also affect the performance of the boat, which may not be acceptable to the more serious or competitive sailors. The attachment means are necessarily quite elaborate, in order that the containers are securely fastened against unintended separation. Finally, the place of attachment does not permit access to the container unless the boat is capsized or overturned, thereby being of no use to the crew in certain boating emergencies in which the boat remains upright.

Examples of life saving equipment and the means for carrying such equipment on boats or other vessels may be seen in U.S. Pat. No. 4,498,879, issued to Burr; U.S. Pat. No. 4,033,002, issued to Higgs; and U.S. Pat. No. 3,754,291, issued to Harris et al. Prior to the present invention, there has been no disclosure of a suitable container for storing survival equipment above the deck of a boat which can be readily accessed and taken overboard in emergency boating situations.

It is therefore a principal object of the present invention to provide a container for storing survival equipment aboard a boat or ship which can be conveniently be stored above the deck in a readily accessible location in the event of an emergency situation.

It is a further important object of the present invention to provide a container for storing survival equipment on a boat or ship which is easily and conveniently handled by one crew member.

It is a further important object of the present invention to provide a container for storing survival equipment aboard a boat or ship which has a simple means for securing the container in place, permitting a quick unfastening of the container from its secured location in an emergency situation.

It is a further important object of the present invention to provide a container for storing survival equipment aboard a boat or ship wherein the securing means also operates as a tether permitting a crew member to tether the container to himself or herself when the container is unfastened from its secured location.

It is a further important object of the present invention to provide a container having the above features storing at least one item of survival equipment.

SUMMARY OF THE INVENTION

The above and other important objects of the present invention are accomplished by providing a container for storing survival equipment on a boat at an above-deck location, where the container may be easily accessed during an emergency requiring the crew to abandon ship. The container is in the shape of an elongated tube adapted to be secured to a desired location above-deck in a lying down, horizontal orientation wherein the vertical profile is relatively low. The tube is made of a corrosion-proof or corrosion resistant material and has a body section, an integral end cap at one end thereof, and a detachable end cap at an opposite end which is capable of being sealed to the body section in a substantially airtight and watertight manner.

The desired survival equipment is inserted into the open end of the body section of the tube and the detachable end cap is then secured thereto and is preferably then sealed with tape. A tether is attached to the detachable end cap and is used to lash down the container by wrapping the tether around the container and preferably around a handrail disposed on an outer surface of the cabin of the boat against which the container rests. The tether retains the container in the desired position during normal operation, and allows the tube to be quickly removed by unwrapping the tether from around the tube. The tether preferably has an eye splice at its free end through which a person can insert his or her hand to ensure that the container remains close to the person after the container and person have left the main vessel.

The container and the tether may be made in a bright yellow color, and may have SOLAS (safety of life at sea) reflective material disposed at selected locations around its outer peripheral surface, which are both features directed to improving the visibility of the container on the boats, in the open seas, and/or at night, and may serve to assist in locating the crew in a search and rescue operation.

The container is preferably of a size and construction wherein it will hold up to about six times its weight in survival equipment while remaining buoyant or floatable in salt water. The total packed weight of the container is preferably no more than about 50 pounds, as heavier weights, through possible, would be increasingly more difficult to handle in the emergency situation. The majority of the length of the body section of the tube preferably has an outer peripheral surface which is octagonal in cross-section, thereby providing several external flat surfaces which can be placed in abutting relation to parts of the boat to which the tube is to be secured in its stowed position. The one or more of the flat surfaces may contain protrusions and one or more of the flat surfaces may contain recesses disposed to accept the protrusions therein, thus permitting two or more tubes to be retained in a fixed interlocking relationship relative to one another when a plurality of tubes are stowed on the boat.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment of the present invention taken in conjunction with the accompanying drawings wherein like reference characters represent like parts throughout the several views.

DETAILED DESCRIPTION OF THE PREFERRED EMBODIMENT

Figure 1:
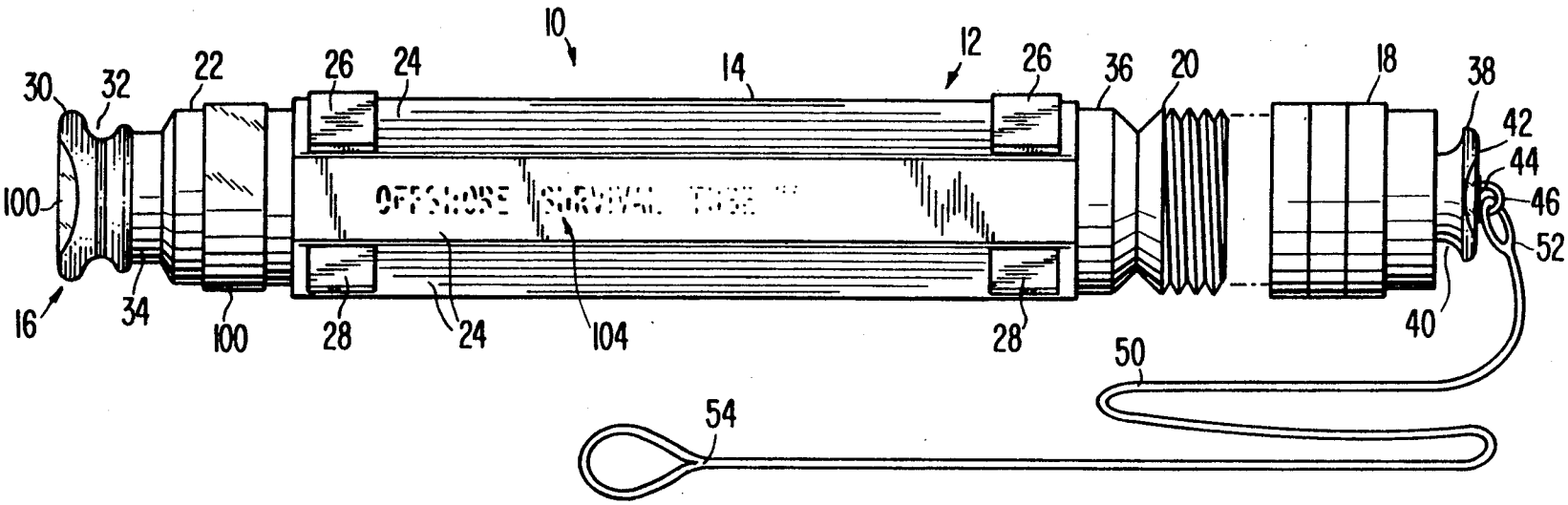
FIG. 1 is a side elevation view of the container according to a preferred embodiment of the present invention, showing the detachable end cap separated from the tube.
Figure 2:
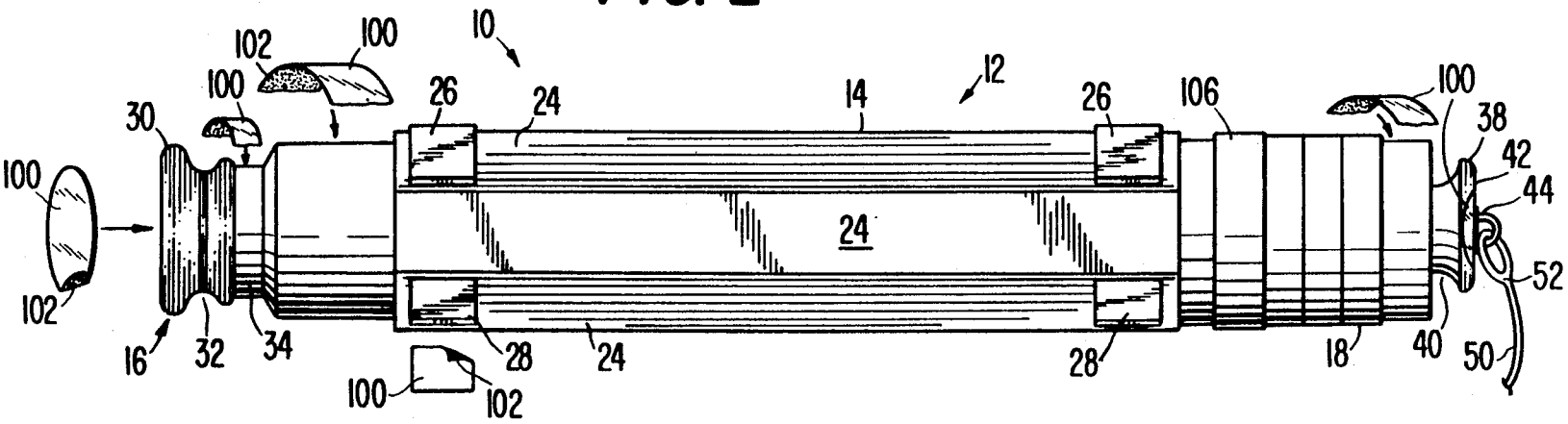
FIG. 2 is a side elevation view of the container according to a preferred embodiment of the present invention, showing the detachable end cap secured to the tube.
Figure 6:
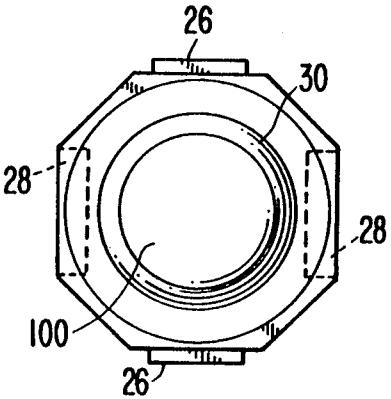
FIG. 6 is a further end view of the container of the present invention taken from the end having the integral end cap.
Figure 5:
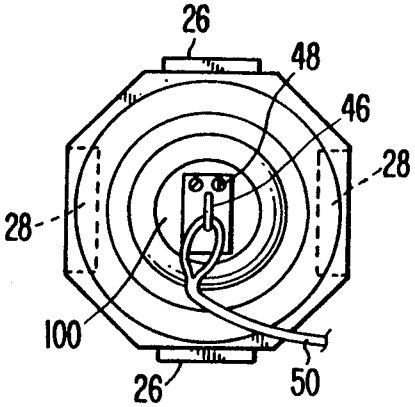
FIG. 5 is an end view of the container of the present invention taken from the end having the detachable end cap.

Referring initially to FIGS. 1 and 2 as well as FIGS. 5 and 6, a container 10 for storing survival equipment at sea in accordance with the preferred embodiment of the present invention is depicted. It is to be noted at the outset that while the ensuing description concentrates on the use of the container 10 on a sailboat, its use is not intended to be so limited, and it will be recognized by those skilled in the art that the invention will be well suited for carrying survival equipment aboard many types of water-going vessels. The basic shape of the container is an elongated hollow tube 12, having a main body section 14, a first end cap 16 and a second end cap 18.

In the preferred embodiment, the first end cap 16 is formed integral with the body section 14, and the second end cap 18 is detachable from the body section. As such, second end cap 18 is located at what can be referred to as the top end or proximal end of the tube, while integral first end cap 16 is disposed at the bottom or distal end of the tube. An interior surface of the second end cap 18 is preferably provided with a spiraling projection (not shown) which enables the end cap 18 to be threaded or screwed onto a complementarily threaded cap receiving end 20 (FIG. 1) of the body section 14 of tube 12, in a manner which will be readily apparent to those skilled in the art.

The body section 14 of the tube 12 is substantially circular in cross-section at cap receiving section 20, and at an opposite end 22 adjacent first end cap 16. The outer peripheral surface of body section 14 extending between cap receiving section 20 and end 22 of the body section, and constituting a majority of the length of the body section, has at least one longitudinally extending flat panel 24. In the preferred embodiment depicted in the Figures, this section comprises an eight-sided outer peripheral surface which is octagonal in cross-section, and thus eight substantially flat panels 24 are provided in this embodiment. As will be discussed later in the specification, an eight-sided intermediate body section provides advantages in the ability to secure the tube to one or more preferred above-deck locations.

One or more of the flat panels 24 of the tube may advantageously be provided with protrusions 26, shown to be square-shaped in the Figures, extending outwardly from the flat panel, and one or more of others of the flat panels may advantageously be provided with recesses 28 of a corresponding shape, adapted to receive therein protrusions 26 from an adjacent tube which will aid in securing two or more tubes 12 relative to one another when stored in a side-by-side manner.

As can best be seen in FIGS. 6 and 7, the protrusions 26 are preferably disposed on two diametrically opposed flat panels on the eight-sided intermediate body section, while the recesses 28 are disposed on diametrically opposed flat panels which are at a 90° orientation to the panels carrying the protrusions 26.

The integral first end cap 16 of the container 10 is preferably smaller in diameter than the cylindrically shaped end 22 to which it is joined. At an extreme distal end, the cap 16 flares radially outwardly to form a knob 30, and a concave annular recess 32 is formed between knob 30 and the cylindrical end 22 of the body section 14 of tube 12. A short cylindrical standoff section 34 may preferably be disposed between the concave annular recess 32 and cylindrical end 22 as well.

The second or proximal end cap 18 is preferably substantially cylindrical around an outer peripheral surface thereof, having a diameter substantially equal to that of the cylindrical section 36 (FIG. 1) of cap receiving end 20 of tube 12. At an outer proximal end, the end cap 18 is provided with a flared knob 38, spaced apart from the cylindrical portion of the end cap by annular recess 40, which is preferably also of a concave shape as seen in FIGS. 1 and 2.

Disposed at an outer extremity of proximal end cap 18, at an outer face 42 of flared knob 38 in the depicted preferred embodiment, is a tether mounting means 44. The tether mounting means 44 in the preferred embodiment comprises a stainless steel pad eye 46 secured to the outer face 42 with a plurality of screws 48 (FIG. 5) backed by associated stainless steel fender washers and stainless steel nuts (not shown) disposed at the interior surface of the outer face 42. In order to ensure that end cap 18 retains its watertight and substantially airtight properties, a marine-grade caulk or sealant, for example Scotch® brand 5200 marine sealant, is used to seal seams and openings in and around the pad eye 46 and screws 48.

A tether 50 having a first closed loop formed by a first eye splice 52 at a first end is secured at the end cap 18 by pad eye 46. The tether also preferably has a second closed loop formed by a second eye splice 54 at its other end, for purposes to be described in more detail later in the specification. The tether 50 is preferably a polypropylene rope constructed to have the ability to float, and it has been determined in accordance with the present invention that the tether should preferably be about 15 feet in length.

The tube 12, including body section 14, integral end cap 16 and detachable, screw-on/screw-off end cap 18, is preferably constructed of a high density, military grade polyethylene, which is highly corrosion resistant. The tube 12 is preferably manufactured or molded in a Federal Safety Yellow color with an ultraviolet (UV) protection ingredient, so that the tube may be readily identified and located by the crew in an emergency (abandon ship) situation, as well as to aid rescuers in locating the crew members at sea. The tether 50 is preferably provided in the same color for the same reasons.

The elongated, tube-like configuration of the survival equipment container 10 described above with respect to a preferred embodiment thereof advantageously provides numerous locations and surfaces to which reflective material 100 may be adhered, primarily for night visibility, again for assisting the crew in locating the container and for assisting rescuers in locating the crew. As best seen in FIG. 2, a SOLAS (Safety Of Life At Sea) grade reflective material 100, having an adhesive 102 on one side thereof, may be cut to shape and placed on one or more, and preferably all, of the depicted locations, namely on the end of knob 30 on end cap 16, around the cylindrical standoff portion 34 of end cap 16, around the cylindrical end 22 of body section 14, in the recesses 28 on flat panels 24, around the outer end of the cylindrical portion of detachable proximal end cap 18, and at the outer face 42 of knob 38 on end cap 18, surrounding tether mounting means 44. A suitable SOLAS grade reflective material is manufactured by 3M Company under its Scotch® brand name and is commercially available.

It is to be noted at this point that many, if not most, adhesives do not adhere well to polyethylene surfaces, and given the particularly harsh environment to which container 10 will be exposed on a regular basis, it was recognized in developing the container of the present invention that it would be desirable to improve the adhesion characteristics of the polyethylene material. The tube is therefore preferably washed in solvent and corona or flame treated prior to application of the pieces of reflective material 100.

It is also desirable, in accordance with a preferred embodiment of the present invention, to provide indicia 104, identifying to crew members that the container holds survival equipment which should be taken from the craft in an "abandon ship" situation. The indicia preferably comprises large lettering of a two part epoxy which may be silkscreened onto one or more of the flat panels 24, enabling easy and quick identification. Again the corona or flame treatment of the polyethylene enables much improved adhesion of the indicia 104 to the panel or panels 24.

In preparing the container for deployment aboard ship, the proximal end cap 18 is detached from the body section 14 of the container, allowing access to the hollow interior (not shown) of the body section. One or more, and preferably a plurality of, survival items are placed in the hollow interior of the body section. Various strategies may be employed in selecting the items to be included in the contents of container 10, depending upon the various conditions, both expected and unexpected, which might be encountered during a particular voyage or outing. The preferred size of the tube, chosen to conveniently fit in a desired storage location aboard the majority of sailboats, is about 40 inches long once assembled, and is approximately 7 inches wide at its widest point. The tube as so constructed will weigh about seven pounds empty, and will be able to hold and float approximately 40 pounds of equipment, or about six times the weight of the tube itself, in salt water.

Other pertinent preferred dimensions for this size of container are that the body section 14 be about 32 inches long, and the octagonal cross-section intermediate portion of the body section be about 24 inches long. The opening into the interior of the body section of a tube of this size is preferably on the order of 5 inches. The opening is of sufficient size to permit a user's hand to enter into the interior of the tube.

While it is possible to vary the amount and types of survival equipment selected and stored in the container 10, a particularly effective and desirable set of contents, generated in accordance with the size and weight limitations of the container 10 of the present invention, and having a total weight of about 32 pounds, is as follows:

1. 6 days of food rations (Verkade/Holland)
2. 6 days waterpacks (Datrex)
3. a. 1 waterproof flashlight (WEST) Small—with extra batteries b. 1 waterproof flashlight (IKELITE) Large—with extra batteries
4. 5 cyalume lightsticks (WEST)
5. 1 10 mile signal mirror (Sigma Scientific)
6. 4 IKAROS (SOLAS GRADE) red aerial flares—1000'; 2 POLAROS (SOLAS GRADE) hand held flares; 8 miniflares (Plains Wessex)
7. 1 dye marker
8. EPIRB RLB-21 (satellite locator)
9. Red Cross First Aid Kit (with solar blanket & antibiotic ointment)
10. Sea Lab 1000/VHF handheld (1 watt) radio
11. Waterproof bag for VHF
12. Self Welding Tape
13. Whistles (2)
14. 1 small pole spear (with extra rubber & tip)
15. fishing kit in container
16. 1 survival knife
17. 2 sunscreen (Bullfrog) 36 S.P.F.
18. 1 pair plastic gloves
19. nylon string & polyurethane bags
20. solar still or watermaker
21. seasickness medication
22. trauma kit (iodine prep pads & forceps etc.)
23. 1 strobe light (SOLAS)
24. 1 sponge
25. basic navigation kit
26. survival instructions
27. safety tin opener (2)
28. 1 handy pocket survival tool
29. 2 Kevlar glove
30. 1 tube zinc oxide
31. 2 small rubbermaid containers—for storage Optional:
32. Icom IC-MII 6 Watt Hand-Held VHF radio
33. Inflatable PFD With the above items packed in the container 10, six days of food and water on full ration level are provided, and this can be extended to twelve days of food and water on half-rations. The six-day supply items listed above will occupy about 25% of the available volume inside the tube, thus leaving ample room to also store other desired food or drink items, based on personal preference. A fifteen day supply (30 day on half-ration) may optionally be provided in the container, which would occupy approximately 70% of the container volume.

Once the desired contents are placed inside the container 10, the proximal end cap 18 is attached to the body section 14, in a screw-on manner in the depicted preferred embodiment. The annular seam where end cap 18 meets the cylindrical section 36 of cap receiving end 20 of body section 14, is preferably sealed with a Scotch®/3M No. 483 industrial tape 106, in order to ensure a watertight and substantially airtight seal between the body section and proximal end cap 18, as well as to prevent relative rotation between these two components which would tend to cause the components to become separated or unscrewed.

Figure 3:
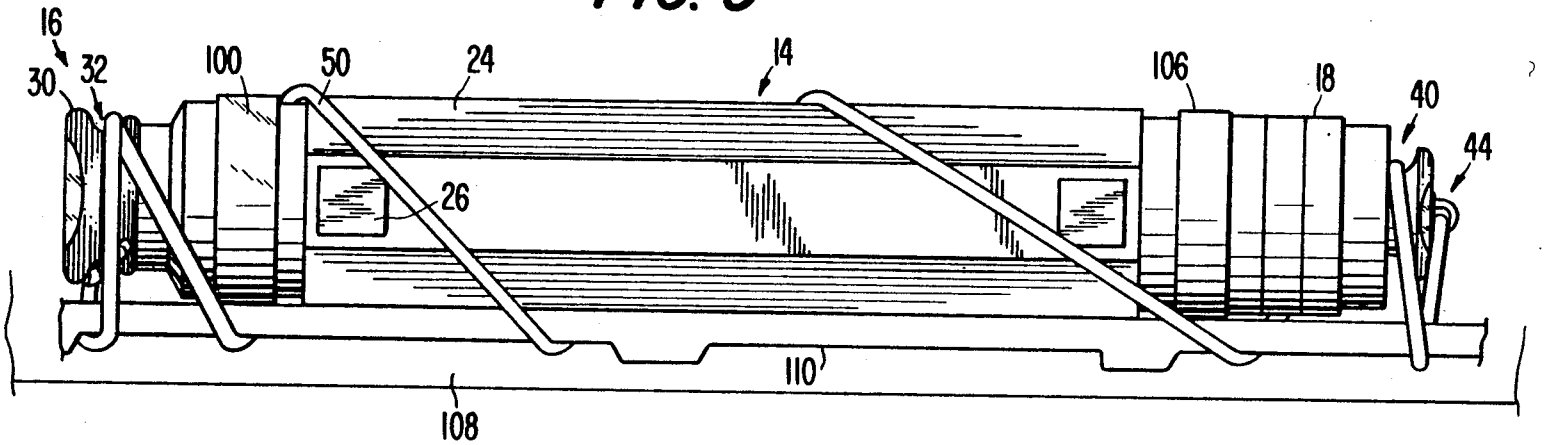
FIG. 3 is a top plan view of the container of the present invention shown secured to a boat.
Figure 4:
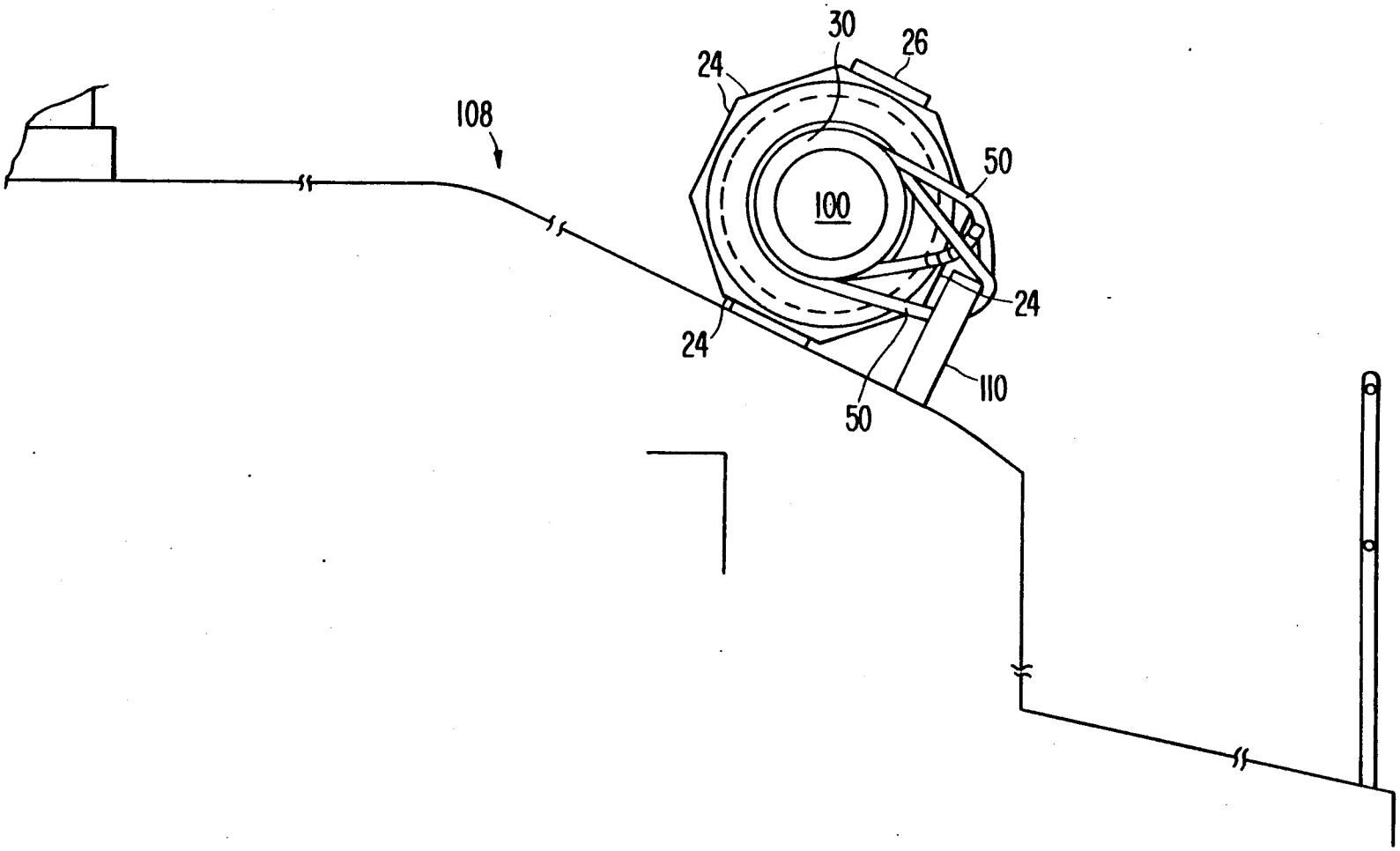
FIG. 4 is an end view of the container of the present invention shown secured to a boat taken from the end having the integral end cap.

Turning now to FIGS. 3 and 4, the preferred means for securing the packed container 10 to a sailboat will be described. As discussed earlier in the specification, it is highly desirable to store the container in an above-deck location on the sailboat. FIG. 3 is a view of the deck 108 of sailboat looking down onto the deck, while FIG. 4 is a substantially schematic silhouette-type view of the deck as viewed in a bow-to-stern direction. A handrail 110 is commonly provided on the top surface of the deck 108 of the boat, the handrail 110 extending in a fore-and-aft direction along the deck. The container is advantageously secured to the handrail 110 by lashing the container to the rail with its attached tether 50. To secure the container in position, the tether is simply wrapped around the container and handrail, preferably on the order of five times, including at least one wrap around each annular recess 32, 40 on end caps 16, 18, respectively. The tether may be tied off with three single half-hitches at the forward end thereof. The length of the tether is preferably approximately four times as long as the total length of the container 10, in order to provide sufficient length for the wrapping and tying. In addition, the tether is preferably at least about 15 feet in length so that the container may be rolled or dropped overboard while remaining tethered to a crew member onboard the boat.

As can be seen particularly by having reference to FIG. 4, the provision of at least one flat panel 24 on the body section of the container yields a stable bottom resting surface for the container. A second flat panel is advantageously disposed to rest against the handrail 110. The octagonal cross-sectioned body section 14 of the container 10 provides the flat panels 24 at the proper orientations because the handrail 110 generally is mounted to form a right angle with the deck 108. The symmetrical nature of this octagonal section about a longitudinal axis of the container coupled with the ability of the tether 50 to secure the container no matter which panels engage the deck and the handrail, substantially eliminates any need to precisely place the container for securing to the handrail. It is preferred, however, to have a panel carrying indicia 104 (FIG. 1) facing upwardly for ready identification purposes.

In the event of an emergency, the tether 50 is simply untied, and unwrapped or slipped from around the handrail. The person releasing the tether may advantageously slip one hand through the second eye splice disposed at the free end of the tether, and the container 10 may then be carried off or rolled off the deck into an awaiting life raft or dinghy. By virtue of the container at this point being tethered to one of the crew member's arms, the survival equipment is prevented from being separated from that sailor. In an extreme emergency, wherein there may not be sufficient time to untie the tether, the container may be freed by cutting through the tether with a rigging knife, for example.

It is not an absolute requirement of the present invention to secure the container to a handrail, although this is believed to be one of the most convenient securing locations in terms of remaining out of the crew's way during normal sailing operations while at the same time being readily accessible during an emergency. Some boats will not be outfitted with handrails, and on a small percentage of other boats, the container may not provide a good fit against the handrail. In those instances, other boat hardware may be employed in securing the container to the deck with its own tether. A toerail, a pair of stanchions, or a pair of shrouds, all well known pieces of equipment to the sailing community in general, may be put into service as tie-down elements. As a further example, on power yachts, which will generally not be outfitted with any of the above-mentioned deck hardware, it would be possible to mount a pair of teak chocks to a deck or cabin top. A further alternative mount (not shown) which may be employed could be provided on the stern of the boat. All of the mounts described above share in common the feature that the container 10 is secured and maintained in a substantially horizontal orientation, which is the preferred stowage orientation for coping with high seas.

The foregoing description includes various structural details according to a preferred embodiment of the present invention, however, it is to be understood that this is for illustrative purposes only. Various modifications and adaptations may become apparent to those of ordinary skill in the art, without departing from the spirit of the present invention. Accordingly, the scope of the present invention is to be determined by reference to the appended claims.

I claim:

1. A survival equipment storage container comprising:

an elongated hollow tube made of a corrosion resistant material, said tube having a body section and a first and a second end cap at opposite ends of said body section, said end caps being sealed to said body section in a water-tight manner when said container is assembled, at least one of said first and second end caps being detachable from said body section to provide an access opening of sufficient size to permit a user's hand to enter an interior of said tube;

wherein said body section and said first and second end caps define a storage volume in said interior of said tube; and wherein an outer peripheral surface of said body section has at least a first substantially flat panel extending along a predetermined portion of the length of said body section;

said container having tether means attached thereto for securing said container to mounting means disposed at an above-deck location on a vessel, and wherein at least one of said first or second end caps has an annular recess disposed adjacent said body section.

2. A container as recited in claim 1 wherein said first end cap is formed integral with said body section, and said second end cap is detachable from a proximal end of said body section.

3. A container as recited in claim 2 wherein said second end cap has thread means disposed on an interior surface thereof for engaging complementary thread engaging means disposed at said proximal end of said body section.

4. A container as recited in claim 3 wherein said second end cap is sealed to said body section by a length of waterproof tape adhered to said second end cap and to said body section, and extending around a circumference of said second end cap and said body section.

5. A container as recited in claim 2 wherein said tether means comprises a rope, a first end of said rope being attached to one of said first or said second end caps.

6. A container as recited in claim 5 wherein said rope is attached to said second end cap.

7. A container as recited in claim 6 wherein said rope has a closed loop at said first end, and said closed loop is secured to said second end cap through a pad eye disposed on said second end cap.

8. A container as recited in claim 7 wherein said rope has a closed loop at a second, free end of said rope of a size sufficient to receive therethrough a person's hand.

9. A container as recited in claim 6 wherein said rope has a closed loop at a second, free end of said rope of a size sufficient to receive therethrough a person's hand.

10. A container as recited in claim 1 wherein said tether means comprises a rope, a first end of said rope being attached to one of said first or said second end caps.

11. A container as recited in claim 10 wherein said rope has a closed loop at said first end, and said closed loop is secured to said first or said second end cap through a pad eye disposed on said first or said second end cap.

12. A container as recited in claim 10 wherein said rope has a closed loop at a second, free end of said rope of a size sufficient to receive therethrough a person's hand.

13. A container for storing equipment on a water-going vessel for survival at sea comprising:

an elongated hollow tube made of a corrosion resistant material, said tube having a body section and a first and a second end cap at opposite ends of said body section, said end caps being sealed to said body section in a water-tight manner when said container is assembled, at least one of said first and second end caps being detachable from said body section to provide access to an interior of said tube;

wherein said body section and said first and second end caps define a storage volume in said interior of said tube; and wherein an outer peripheral surface of said body section has at least a first substantially flat panel extending along a predetermined portion of the length of said body section; and said container having tether means attached thereto for securing said container to mounting means disposed at an above-deck location on said vessel;

wherein said tether means comprises a rope, a first end of said rope being attached to one of said first or said second end caps; and wherein said first end cap comprises an annular recess disposed between said body section and a flared knob at an outer end of said first end cap adjacent to said annular recess.

14. A container as recited in claim 1 further comprising a plurality of pieces of reflective material disposed at predetermined positions on said container.

15. A container as recited in claim 14 wherein at least one of said plurality of pieces of reflective material extends completely around an outer peripheral surface of said container at a predetermined position along a longitudinal axis of said container.

16. A container as recited in claim 15 wherein each of said first and said second end caps has one of said plurality of pieces of reflective material disposed thereon.

17. A container as recited in claim 1 wherein at least a second substantially flat panel extends along said predetermined portion of the length of said body section, said second flat panel being disposed in a plane perpendicular to a plane in which said first substantially flat panel is disposed.

18. A container as recited in claim 17 wherein said predetermined portion of the length of said body section comprises an intermediate body section which is octagonal in cross-section, wherein eight flat panels extend along said predetermined portion of said body section length.

19. A container as recited in claim 18 wherein said intermediate body section extends over more than one-half of the entire length of the assembled container.

20. A container for storing equipment on a water-going vessel for survival at sea comprising:

an elongated hollow tube made of a corrosion resistant material, said tube having a body section and a first and a second end cap at opposite ends of said body section, said end caps being sealed to said body section in a water-tight manner when said container is assembled, at least one of said first and second end caps being detachable from said body section to provide access to an interior of said tube;

wherein said body section and said first and second end caps define a storage volume in said interior of said tube; and wherein an outer peripheral surface of said body section has at lest a first substantially flat panel extending along a predetermined portion of the length of said body section; and said container having tether means attached thereto for securing said container to mounting means disposed at an above-deck location on said vessel;

wherein at least a second substantially flat panel extends along said predetermined portion of the length of said body section, said second flat panel being disposed in a plane perpendicular to a plane in which said first substantially flat panel is disposed; and wherein said predetermined portion of the length of said body section comprises an intermediate body section which is octagonal in cross-section, wherein eight flat panels extend along said predetermined portion of said body section length; and wherein at least a first one of said flat panels has at least one protrusion extending outwardly therefrom and at least a second one of said flat panels has at least one recess corresponding in geometry to said at least one protrusion, said at least one recess being adapted to receive therein a protrusion from an adjacent container.

21. A container as recited in claim 20 wherein said at least a first one of said flat panels and a flat panel diametrically opposed to said at least a first one of said flat panels each have at least one of said protrusions extending therefrom.

22. A container as recited in claim 21 wherein said at least a second one of said flat panels and a flat panel diametrically opposed to said at least a second one of said flat panels each have at least one of said recesses therein.

23. A container as recited in claim 22 wherein said flat panels having protrusions thereon and said flat panels having recesses therein are disposed at 90° orientations to one another about a longitudinal axis of said container.

24. A container as recited in claim 1 wherein said tube is made of a substantially rigid polyethylene material.

25. A container as recited in claim 24 wherein an exterior surface of said tube is corona treated.

26. A container as recited in claim 25 wherein said tube contains identifying indicia on an exterior surface thereof.

27. A container as recited in claim 26 wherein said exterior surface further has reflective material adhered thereto.

28. A container as recited in claim 24 wherein said tube is of a size and construction to be buoyant in salt water while holding survival equipment weighing up to about six times a weight of the empty tube.

29. A container as recited in claim 28 wherein said tube is on the order of about 40 inches in length and said tether means is about 15 feet in length.

30. A container as defined in claim 1 further comprising a plurality of items stored in said interior thereof which are adapted to aid in survival at sea.

31. A container for storing survival equipment on a water going vessel comprising:

an elongated hollow tube made of a corrosion-resistant material and having a body section which is octagonal in cross-section over a majority of a length of said body section, a first end cap formed integrally with said body section and disposed at a first end thereof, said first end cap having a flared knob at an outer end and an annular recess disposed between said knob and said body section, and a second detachable end cap adapted to be secured and sealed to an end of said body section opposite said first end cap; and said second end cap having tether means for securing said container to said vessel at an above-deck location, said tether means comprising a polypropylene rope secured at a first end to said second end cap, and having a loop at a second free end of said rope, said loop being of a size sufficient to allow a person's hand to be inserted therethrough, wherein said tether means is adapted to be wrapped around said container and around a predetermined securing means on said vessel to removably secure said container in place at said above-deck location on said vessel.

32. A survival equipment storage container comprising:

an elongated hollow tube made of a corrosion resistant material, said tube having a body section and a first and a second end cap at opposite ends of said body section, said body section and said first and second end caps defining a storage volume in an interior of said tube;

means for providing access to said interior of said tube;

said tube having an annular recess disposed between said body section and at least one of said first and second end caps; and tether means attached to said container for engaging said at least one annular recess in a wrap around manner.

* * * * *